US007172521B1

(12) United States Patent
Novis

(10) Patent No.: US 7,172,521 B1
(45) Date of Patent: Feb. 6, 2007

(54) SOCCER TRAINING AIDE

(76) Inventor: David Novis, 3305 Elkhorn Blvd., #2, North Highlands, CA (US) 95660

( * ) Notice: Subject to any disclaimer, the term of this patent is extended or adjusted under 35 U.S.C. 154(b) by 0 days.

(21) Appl. No.: 11/203,632

(22) Filed: Aug. 15, 2005

(51) Int. Cl.
*A63B 69/00* (2006.01)

(52) U.S. Cl. ..... 473/446; 473/422; 473/438

(58) Field of Classification Search ..... 473/422, 473/446, 452, 438, 218, 419; 434/251, 247
See application file for complete search history.

(56) References Cited

U.S. PATENT DOCUMENTS

| | | | | | |
|---|---|---|---|---|---|
| 4,204,346 | A * | 5/1980 | Fugere | 36/114 |
| 5,099,530 | A * | 3/1992 | Scott | 5/420 |
| 5,216,827 | A * | 6/1993 | Cohen | 36/134 |
| 5,290,043 | A * | 3/1994 | Vidinic | 473/446 |
| 5,452,896 | A * | 9/1995 | Core | 473/164 |
| 5,697,791 | A * | 12/1997 | Nashner et al. | 434/247 |
| 5,947,845 | A * | 9/1999 | Canelas | 473/446 |
| 6,128,794 | A * | 10/2000 | Pariseau | 5/413 R |
| 6,711,766 | B2 * | 3/2004 | Monk et al. | 5/420 |
| 6,846,252 | B2 * | 1/2005 | Nudo | 473/446 |
| 7,033,289 | B2 * | 4/2006 | Sharrocks | 473/446 |
| 7,066,849 | B2 * | 6/2006 | Budaj | 473/446 |
| 2003/0228942 | A1 * | 12/2003 | Hsieh | 473/446 |

* cited by examiner

*Primary Examiner*—Mitra Aryanpour
(74) *Attorney, Agent, or Firm*—Mark C. Jacobs

(57) ABSTRACT

A device for teaching the basic kicks of soccer to students of the game. The device has a mat portion with a ball support thereon, to raise the ball to the elevated position it would be in when laying on grass. The mat includes an alignment arrow to direct the approach of the kicker, a circumscribed open area for the non-kicking foot to be prior to ball impact with a specifically notated ball, that rests on the support. The ball is color coded with sweet spots where impact is to take place for a specific kick. The ball also includes similarly color coded arrow lines, which serve to guide the placement of the ball onto the support to align the ball correctly relative to the kicker's shoe for the shot being taught. Teaching information is also found on the mat portion as a mental reinforcement to a lesson.

17 Claims, 4 Drawing Sheets

SOCCER TRAINING AIDE

FIELD OF THE INVENTION

This invention relates to a special structure to aid in the instruction of the basic kicks of the soccer ball to students of the game. An information and specifically configured mat, carrying mat having a ball support thereon, combined with a special notated soccer ball, are used in combination to teach the five basic kicks of the ball to students of the game.

BACKGROUND OF THE INVENTION

The applicant herein is of English heritage and has played soccer professionally and coached soccer, especially little kids of all ages. For over 21 years, children in this age group have lots of energy to play but often do not know the fundamentals, let alone the nuances of the game of soccer. One aspect that kids do not recognize is the existence of the five basic kicks, and where to strike the ball both foot wise and position wise to obtain the desired kick result. The use of this aide reduces the frustration associated with having the ball go where the kicker does NOT want it to go, much like the frustration experienced by the golfer who continually slices his ball.

In order to overcome the problem of knowing how to kick to achieve the desired result each and every time, it is important for the kicker student to plant the non-kicking foot, which for the purposes of this patent application will be deemed the left foot, at the proper location, in order to bring the kicking right foot into proper contact with the soccer ball to achieve the desired result. These five kicks are the lace kick, the side foot inside kick, the chip shot, the knuckle shot and the curve kick.

The combination apparatus of this invention overcomes the difficulties of learning and retaining the distinctions to achieve each of the five main kick results.

Nomenclature—The abbreviations used herein with the test and on the drawing sheets are:

Sweet Spot—the desired point of impact on the soccer ball relevant to a particular kick. Each kick has a different sweet spot.

1. LK=Lace Kick
2. ISFK=Inside Side Foot Kick aka Side Foot
3. CH=Chip Shot
4. KS=Knuckle Shot
5. BE=Bend Shot Reference is made to FIG. 13 which is of a typical athletic shoe as often used by younger soccer players, rather than a true soccer cleated shoe, due to their inability to negotiate the use of cleats. FIG. 13 illustrates the locations on the shoe for the impact of the various kicks to be taught by this invention.

RMA, CMA and LMA all refer respectively to the right, center or left mat area of the rubber or plastic mat forming a major aspect of this invention.

The invention accordingly comprises the device possessing the features, properties, the selection of components which are amplified in the following detailed disclosure, and the scope of the application of which will be indicated in the appended claims.

For a fuller understanding of the nature and objects of the invention, reference should be made to the following detailed description, taken in conjunction with the accompanying drawings.

SUMMARY OF THE INVENTION

This invention pertains to a teaching aid for students desirous of learning the five fundamental kicks used in the game of soccer. The aid is the combination of a mat to be placed on the grass, street or dirt and a specially notated soccer ball. The mat has a built-in support to slightly raise the ball to simulate the position of the ball as if it were lying free in the grass on a soccer field.

It is a first object to provide a soccer kick teaching aid for use by young and old alike.

It is a second object to provide a teaching aid that is low in price, yet sturdy and thus suitable for all ages, both boys and girls.

It is a third object to provide a teaching aid that places the soccer ball in a position as if it were lying on the grass of a soccer field.

It is a fourth object to provide a kick teaching aid suitable for both left and right footed kickers.

It is a fifth object to provide a teaching aid that mentally segregates for the user the correct means of kicking a soccer ball in each of the five kicks.

Other objects of the invention will in part be obvious and will in part appear hereinafter.

DESCRIPTION OF THE PREFERRED EMBODIMENT

Figure 1:
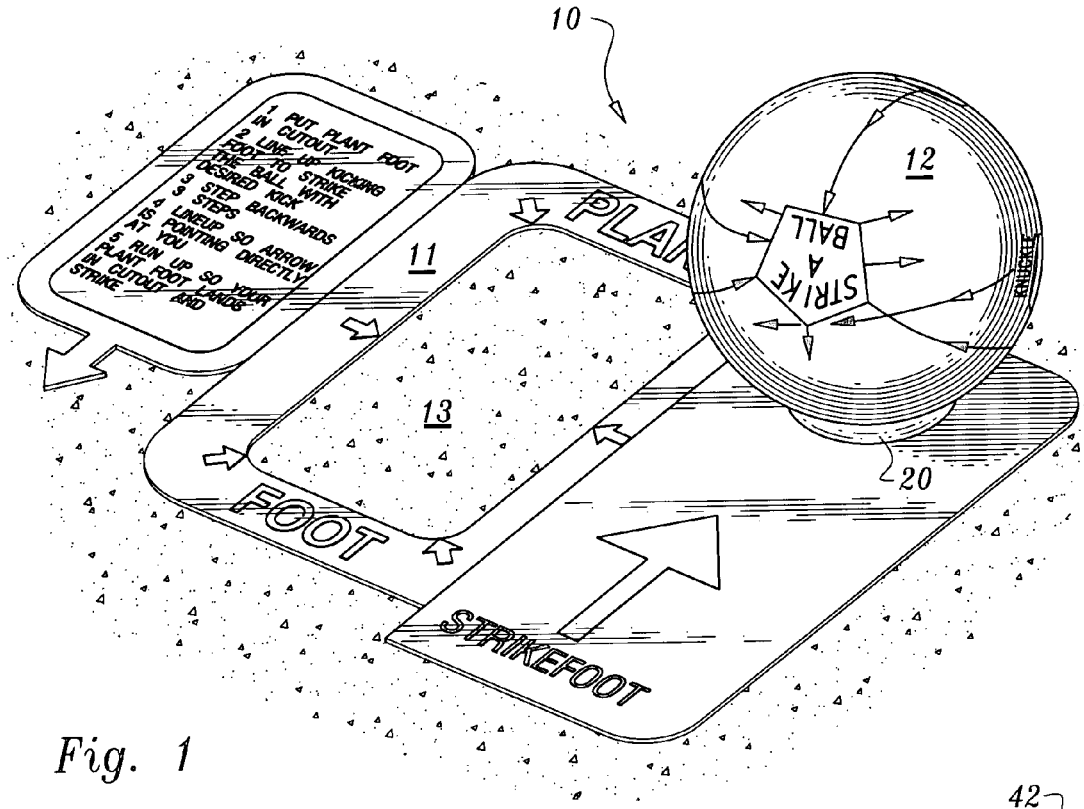
FIG. 1 is a top perspective view of this invention.

In FIG. 1 there is seen the entire invention 10, of this application. The invention consists of a specific mat 11 having a built-in ball support 20 and a modified conventional soccer ball. The ball 12, has been specially notated with indicia for specific use purposes as will be explained.

Figure 2:
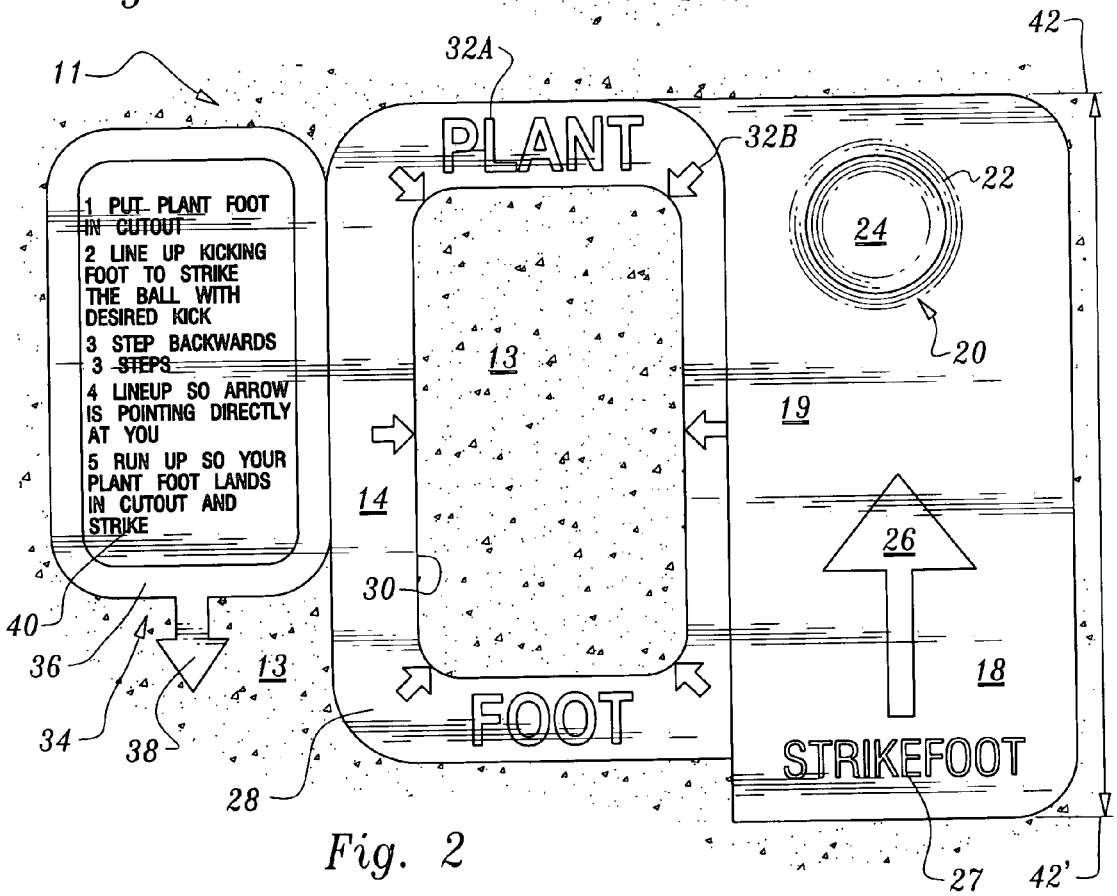
FIG. 2 is a top plan view of the entire mat portion of this invention.

The discussion now moves to FIG. 2, which is a top plan view of the mat portion 11 of this invention resting on the ground 13, which in the drawing is exposed aggregate concrete. The mat 11 has an upper side 14, and a bottom or reverse side 15, seen in FIG. 3. The upper section 14 is divided into a trio of areas, a right area 18, a center area 28, and a left mat area 34. Each of these will be referred to respectively as the RMA, the CMA and the LMA and each will now be discussed.

Turning first to the RMA, where it is seen that this area 18 has a preferably rubber base substrate 19 to endure inclement weather and scuffing. The area is generally rectangular with the word STRIKEFOOT painted thereon, preferably in a raised letter format, such lettering being designated 27. The word is used to indicate to the user that the right foot is to be used, in view of the notation PLANT FOOT that appears on the CMA. A forward pointing arrow 26, also painted in a raised letter format, serves to advise the student, the direction of the foot swing toward a stationary soccer ball. A raised ball support 20 is positioned forwardly of the arrow 26 to retain the ball in a raised position that simulates the placement of a soccer ball on a grass field. Support 20 includes an annulus 22 of approximately four inches in diameter, upon which the soccer ball is placed for kicking. The recess within the annulus 24 is at ground level.

The center area CMA is also a generally rectangular area, directly attached to the RMA. The CMA of a right foot kicker model may have chamfered corners on its upper left and lower left corners to prevent tearing of the CMA at the corners of the side of the area that adjoins the LMA. To help delineate the CMA from the RMA, the CMA may be painted a contrasting color, here white. Other colorimetric delineations may also be employed.

It is upon this painted surface that the indicia PLANT FOOT, 32A is written, preferably in vertically thickened letters (vertical relative to the ground), to prevent easy removal by foot scuffing as well as the inward pointing arrows 32B. Other short instructional information may be alternately used instead. This KISS principle nomenclature is intended to aid students to understand the importance of solidly planting one's foot prior to attempting a shot or kick. The importance of foot placement cannot be overemphasized, since it is by instinct that a kicker would attack the ball head on, that is, straight ahead. But in reality the preferred approach is to have the kicker run angularly toward the ball, plant the foot, and then kick.

While the length dimension of the RMA as seen between arrows 42 and 42' differs from the length dimension of the CMA, which is of lesser length, the preferably oval central opening of the CMA could be extended downwardly to designator 42', so long as the central opening or cutout 30 stays the same. As such, if the CMA were to be lengthened, the cutout 30 would be seen to be off center. The reasoning for that is that the opening 30 was sized to accommodate up to about a size 13 shoe. If the cutout were to be elongated, it is possible that a player might place his or her foot at the wrong spot, relative to the ball support 20 of the RMA, at the time of a kick.

The LMA 34 is seen to be a still smaller generally rectangular planar area having a border zone 36, preferably of a color that contrasts with the color of the CMA, to aide in quick recognition by a moving kicker. Within the border area 34 is a light colored, here white, background area 40 upon which is painted in long lasting letters, certain rules to be read by kickers prior to their use of the device 10. These rules or instructions of use pertain to all of the kicks for which the device is suitable for teaching. This makes for easy reading of the information on how to use the device.

Depending in the same flat plane, from the border area, 36, and outside of the main segment of the of the LMA, rearwardly directed toward the kicker, is an arrow 38 formed of the same material as the mat, which here is rubber. This arrow is several inches long and is designated 38. This arrow serves as a guide in that it is intended to point directly at the kicker during the kicker's run toward the CMA and RMA, at the moment in time just prior to the planting of the left foot in the cutout 30 of the CMA.

Figure 3:
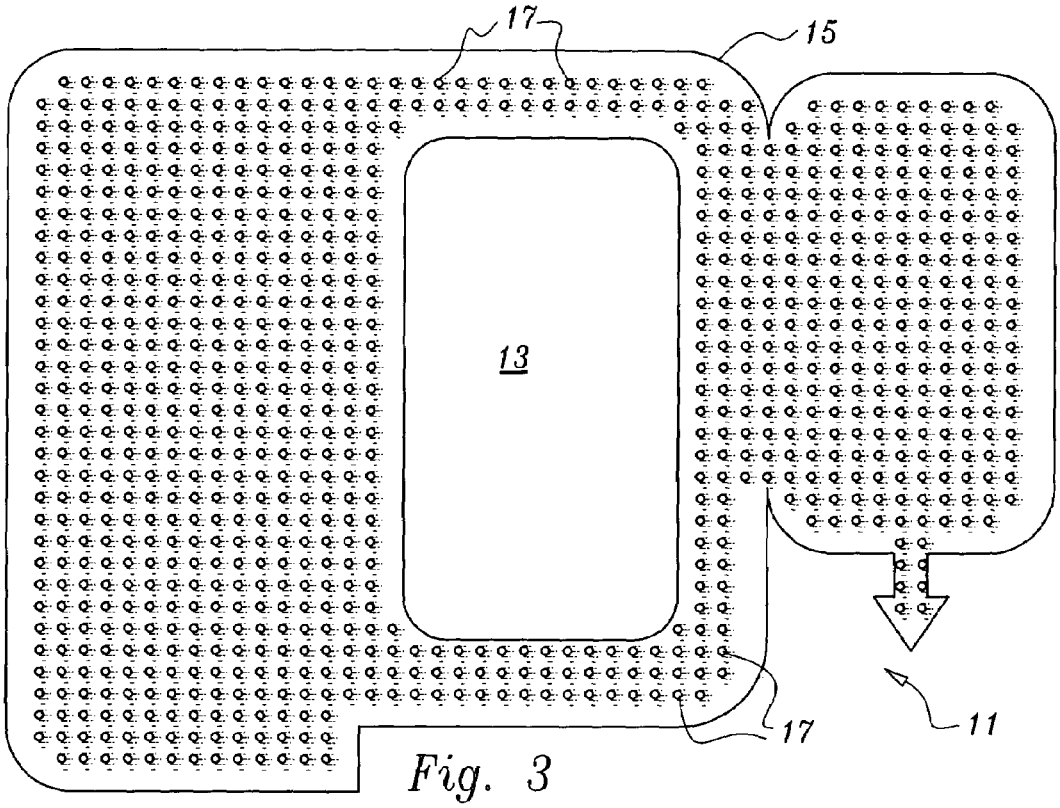
FIG. 3 is a bottom plan view thereof.

FIG. 3 is a planar view of the rear surface 15 of the mat portion. It is seen to be a mat similar as used at the front door or in a car. Surface 15 includes a plurality of aligned in rows slight protrusions 17, which serve to retain the mat in one position, and to prevent slippage, be it on grass or dirt or even wood as in a gymnasium.

Figure 4:
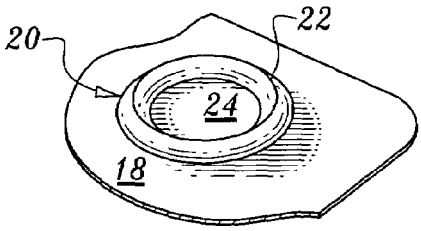
FIG. 4 is a closeup view of the ball support section of the mat portion.

In FIG. 4 there is seen a closeup of the ball support 20, as well as the surface texture of the RMA 18. The surface shown in not critical and bears not on the invention in particular. As to the annulus 22, it can be made of any suitable rubber type material such as adiprene, or polyurethane elastomer, or can be a rigid solid plastic extrusion such as of nylon or even a high density closed cell skinned urethane foam. The annulus can be formed integral with the mat or attached as by a suitable adhesive or fasteners.

Figure 5:
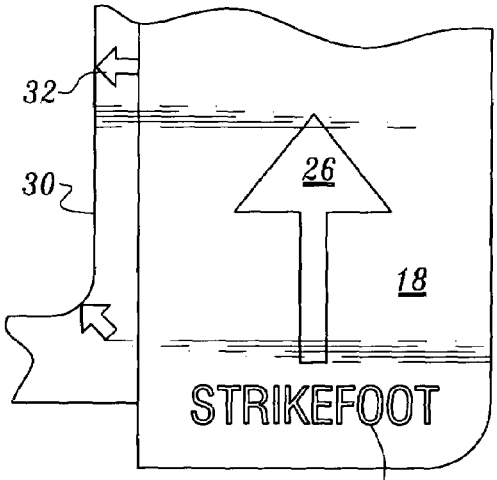
FIG. 5 is a closeup view of the direction providing section of the mat portion.

In FIG. 5, a closeup of the STRIKEFOOT arrow 26 is seen. This can be painted with any paint, though one having solid particles therein to build up the surface texture is preferred. These particulates can be any inert material such as finely divided silica or some other lowcost mineral. The application of such particle containing paints is deemed conventional to those of skill in the painting art. The arrow can be readily stenciled at the location desired. The background is the dark colored unpainted rubber, usually obtained from inclusion of carbon black in the formulation.

It is also to be noted that the dark colored arrow 32, of the CMA, which is also seen in this view is preferably painted in the preferred mode of painting for all of the arrows of the CMA, I.E. a high solids content paint, to reduce wear and tear from repetitive use of the mat. Such marking paint is available in the marketplace. As an alternative, a long-wearing marking paint, available from Aervoe Industries among others will work, but will require a plurality of coats to achieve a built up surface.

Figure 6:
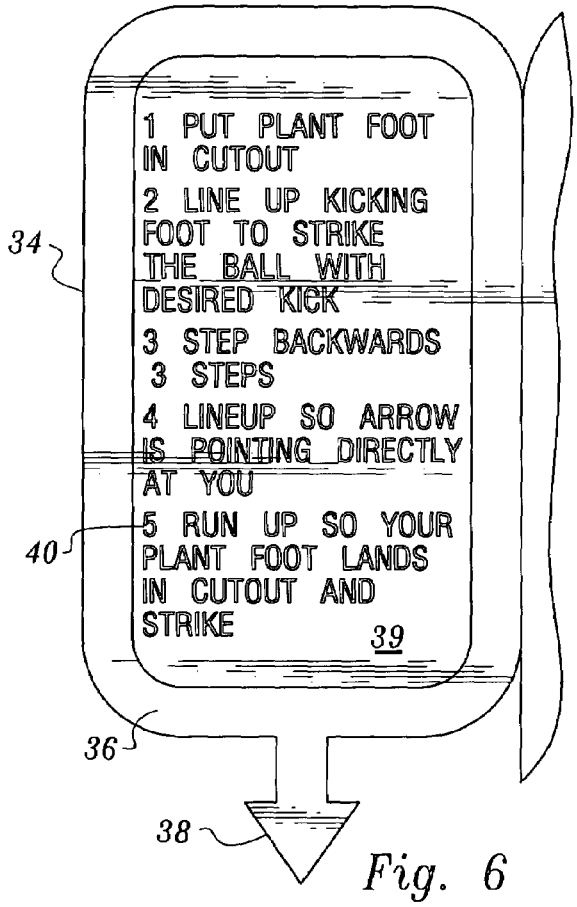
FIG. 6 is a closeup view of the indicia educational section of the mat portion.

The discussion now moves to FIG. 6 where the LMA is featured. The LMA 34, is a generally rectangular section which has a border 36 of a color that preferably contrasts with the CMA, to segregate the LMA from the CMA such that the viewer-kicker can concentrate his or her vision on the one area of device 10 at a time as may be desired. Here the border is again preferably the natural black color of the unpainted rubber mat. The LMA 34 including the arrow to be described below, has a lesser extension from top to bottom than the RMA because it is least in importance of the three areas of the mat portion, and preferably a lesser front to back extension than the CMA as well. The information found thereon is to be read and acted upon by the kicker. Within the border 36, which is about two inches wide is an indicia receiving area 39, upon which certain rules are set forth in print. This indicia is designated 40. The lettering should be about one inch tall in font size for quick ease of understanding from a distance. The instructor can hold the mat 11 in the air for members of a class to read by having the letters of such a one inch or greater size. A successfully used color scheme for the indicia receiving area 39 is white for the background, with black paint thereon for the actual indicia 40.

A part of the CMA is also seen in this view and as such, safety yellow is suggested to mentally segregate the CMA's circumscribing mat zone 28 from the LMA. Again see FIG. 2. The arrow 38 seen in a more distant view of the LMA is not seen in this view FIG. 6, and it has already been fully discussed supra. The exact wording of the indicia pertains only to the instructions for a kicker intent on using the device, as can be realized by a reading of the information present.

Figure 7:
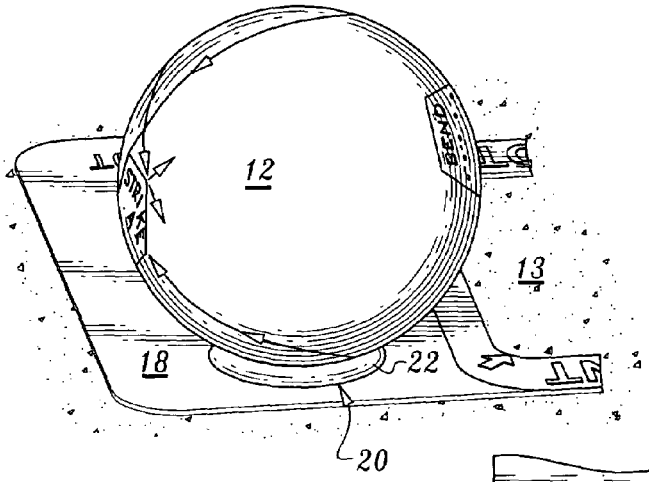
FIG. 7 is a front perspective view of the ball portion disposed on the mat portion of this invention.

In FIG. 7, a special soccer ball 12 is seen resting upon support 20's annulus 22. The construction of the ball per se is conventional and as such it can be procured from one of several manufacturers. As can be seen, certain information including arrows and color keyed blotches with printed information thereon is set forth on the ball, seen resting on annulus 22. The details on the painted indicia on the soccer ball 12 will follow a brief explanation of the basic kicks to be taught by the use of this invention.

The ISFK or inside of the foot behind the toes, by the arch, below the ankle is used to strike the back of the ball during its travel. This kick is used for short accurate passes to adjacent team mates. See the yellow colored ball information if color keyed.

The LK or lace kick is one wherein the party strikes the back of the ball with the lacing of the shoe. This kick is used for making the ball travel the maximum distance, in that it gives lift to the ball. See the green colored information if the ball information is color keyed.

The CH or chip shot is one carried out by striking the ball so that the toes of the wearer go under the ball to obtain elevation into the air. This shot is used to lift the ball over the heads of opposing players. See the red area.

The KS or knuckle shot is one wherein the ball is struck at the center of the ball or the rear face of the ball with the top of the laces and the instep. This forces maximum power through the back of the ball and causes the ball to move in an unpredictable direction in the air. This kick is used for power shooting, such as a goal attempt. See the brown area.

The distinction between the lace kick and the knuckle shot lies in the positioning of the foot in the shoe. For the lace kick, the foot should be set with the bottom of the foot or sole at about a 45-degree angle, such that the ball is momentarily resting on the shoe at the time of impact. The kicker follows through by raising the foot into the air upon the completion of impact. Contrast this with the knuckle shot where the base of the shoe is higher at about a 45-degree angle. Here the ball should impact the shoe near the ankle. The foot acts like a board as if the kicker were hitting the ball with a paddle, and the foot follows through not arcuately but straight ahead.

The BE or bend shot is an angular kick wherein the ball is struck using the part of the foot just below the laces and above the instep, on the outside of the foot. When properly executed the ball will spin causing the ball to travel in a curved trajectory. The shot is used to "bend" the ball around one or more defenders, such that they cannot interfere with or strike the ball. See the pink area.

While certain specific colors have been assigned to the series of kicks, such association is merely arbitrary and other color associations may be employed instead.

Figure 8:
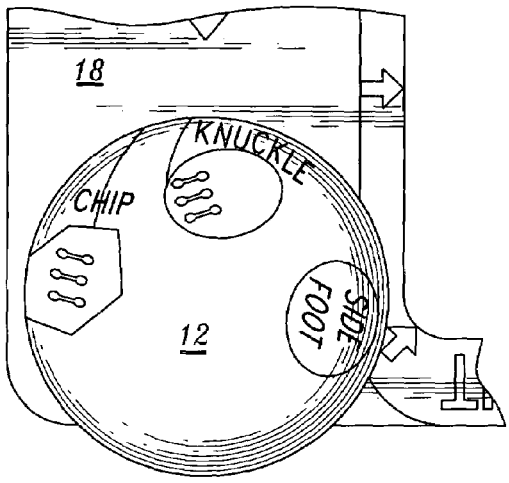
FIG. 8 is a rear elevational view showing certain first indicia on the ball portion while the ball rests on the ball support.

Thus, in FIG. 8, the indicia for the knuckle or knuckle shot is seen in a first color. The sweet spot that is the location on the ball for foot impact, is seen in this figure and is the designated color keyed blotch with the line of arrows leading thereto. The sweet spot for the side kick is also denoted on the ball in this figure.

Figure 9:
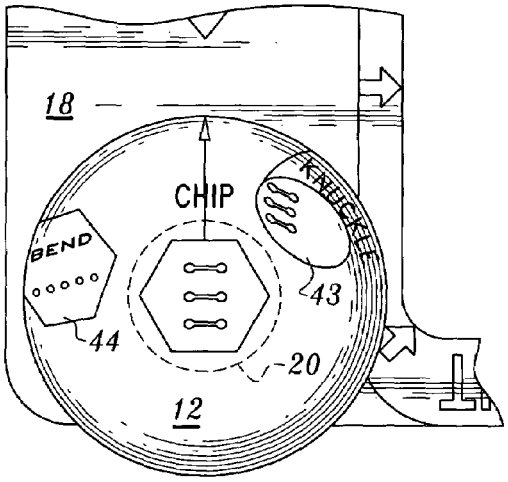
FIG. 9 is a view similar to FIG. 8 showing second other indicia information on the ball portion, at rest on the ball support.

In FIG. 9, again a top plan view of a ball on the annulus support, the reader notes that the ball has been slightly rotated on the support 20. Here the sweet spots 43 and 44 for the knuckle shot and the chip shot are seen. The sweet spot for the chip shot is preferably of a different color from the knuckle shot. The letters "nd" of the word bend are also seen superposed on the sweet spot for the Bend Shot, spaced apart from the other sweet spots just mentioned. As mentioned elsewhere herein, no criticality lies in the specific colors chosen for the various sweet spots and the arrows emanating therefrom.

The reader's attention is drawn to the fact that it is beyond the scope of this application to actually teach the game of soccer and to point out the detailed technical distinctions in the various kicks and the directionality to be achieved by the ball subsequent to impact with the desired portion of the ball by the specific section of the shoed foot, other than as mentioned infra. Suffice it to say, that the terminology and desired locus of impact and directionality to be achieved from each such kick is well-known to devotees of the sport and that the results recited as being intended are indeed achievable on a repeated basis. Even by youngsters.

Figure 10:
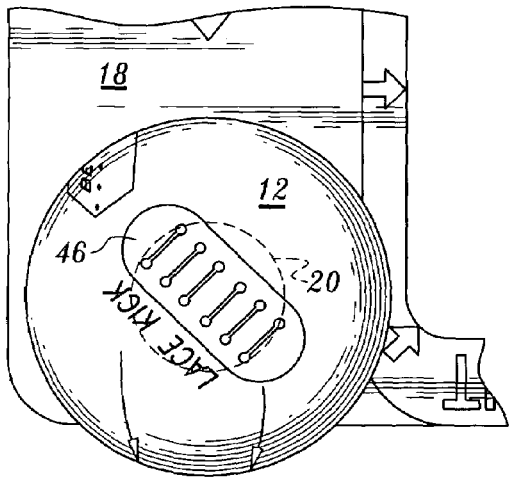
FIG. 10 is a view similar to FIG. 9 showing third other indicia information on the ball portion.

In FIG. 10, the lace kick sweet spot 46 which corresponds to the lace area of the ball is seen and so designated. A portion of the alignment arrow for this kick is also seen in this view. Again it is noted that the same color is being used for any one sweet spot and its directional arrow for alignment on the ball support 20. That is, the colored arrow line that leads from the sweet spot should point to the support. By doing so, the ball is correctly aligned for the shot chosen, and the sweet spot for the chosen shot will be where it is supposed to be for impact with the shooter's foot. This is true for each of the five basic kicks denoted.

Figure 11:
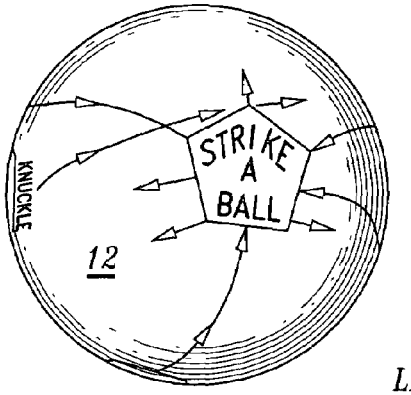
FIG. 11 is a top plan view of the focal point of the ball showing the various kick related arrows.

In FIG. 11, applicant's trademark or another designation is within the pentagonal area of the cover. Note how all of the arrows converge right here. That is because the pentagon is to be set down upon the annulus support and then properly rotated to the proper sweet spot to be taught at that moment in time.

While the use of five arrows for the five basic kicks has been recited for placement on a ball, it is also within the scope of this invention to set forth only one sweet spot and its arrow line, as well as any other number of sweet spots and arrow lines between 1 and 5, especially for the four and five-year-old novices to the game.

Figure 12:
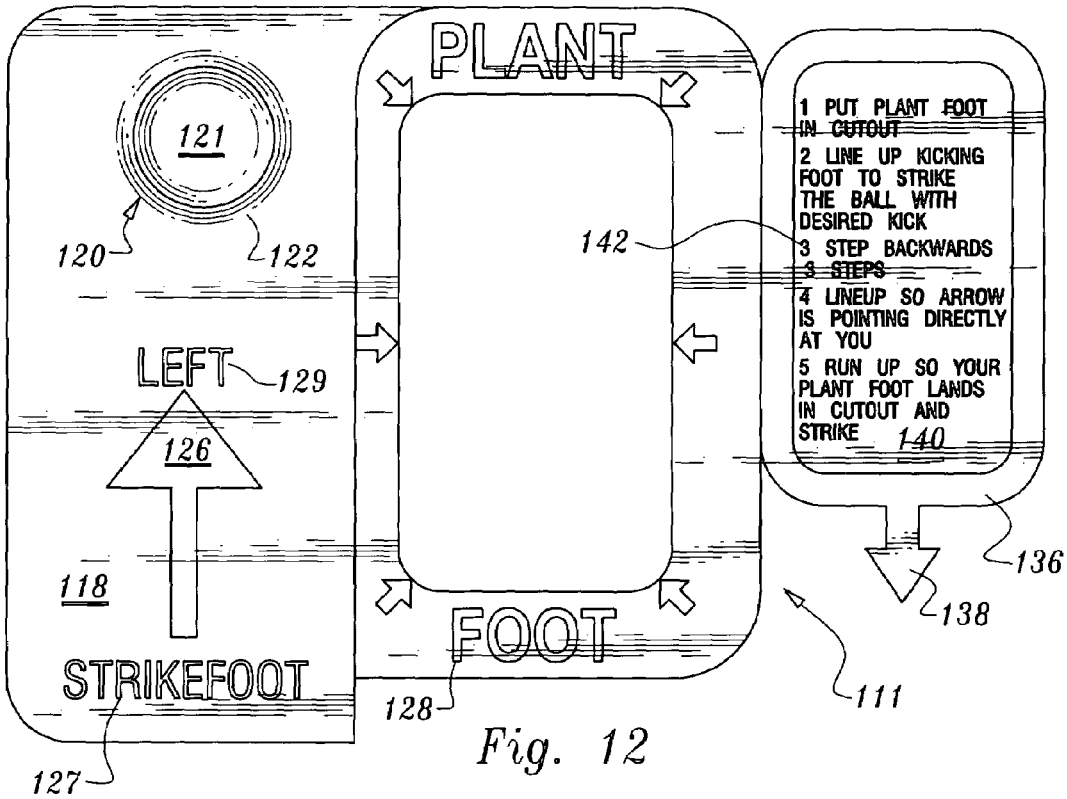
FIG. 12 is a mirror image version of the mat portion for use by a left footed kicker.

FIG. 1 depicted a version of this invention for a right footed shooter, with the left foot to be placed in the CMA prior to the shot. FIG. 12 is a mirror image of the mat portion of intended specifically for left footed kickers with the right foot to be placed in the CMA opening. For this version of the invention, all of the numeric designators previously referred to and discussed for the right footed version of the invention have been utilized here as well but increased to the 100 series of such numerals. Thus element 22 the annulus with its center space 24 has been renumbered 122 for the annulus support and the center space is 121; ad infinitum. Since all other aspects of the mat portion are deemed to be the same, no further discussion is deemed necessary for the left footed kicker unit.

Figure 13:
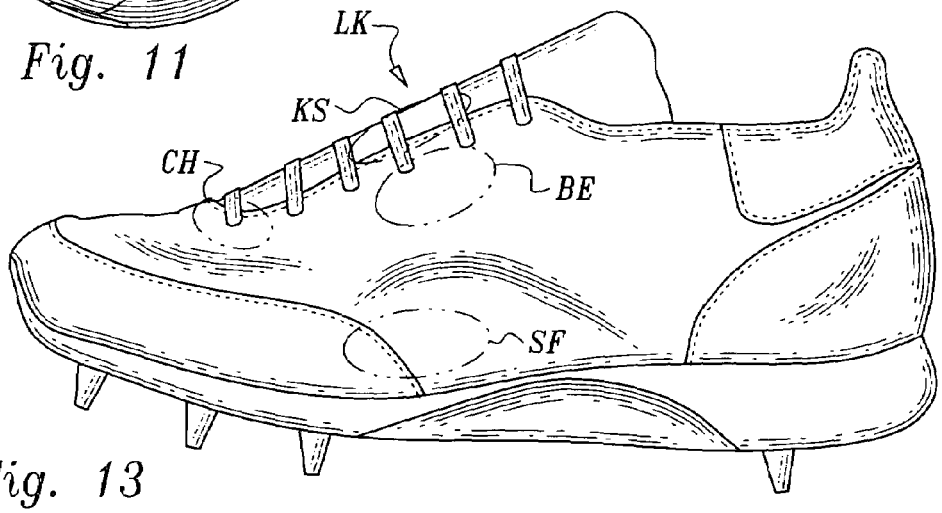
FIG. 13 is a side elevation view of a typical left foot sneaker oI soccer shoe showing the location on the shoe for striking a soccer ball for each of the five basic soccer kicks.

FIG. 13, depicts a typical spiked soccer shoe used by persons of all ages in playing soccer. The locations on the shoe for the various kicks previously discussed, LK, ISFK, CH, KS, BE are denoted on the shoe to help the reader understand where each kick is intended to transpire. Note the two distinct locations at the laces, the lower for the lace kick and the higher for the bend shot. The shoe itself forms no part of this invention.

It is seen that I have devised a new teaching tool for both young and old soccer players to teach them how to make each of the basic kicks of soccer. The arrow 38 on the far left helps the player correctly align the body during the approach, such that the non-kicking left foot steps into the open center area of CMA prior to impact of the right foot with the ball. The device also teaches the child the next step of where to place the non-kicking foot—into the ring adjacent the stationary ball of this device—prior to foot impact with the ball, with the hope that the specific placement concept will carry over to actual play.

It is also seen that if the non-kicking foot is correctly placed, that the kicker will automatically be correctly aligned ALONG SIDE the ball when he or she goes to kick the ball rather than being BEHIND the ball as a punter would be in football. This location relative to the ball permits the kicker to choose the appropriate shot for the situation at hand.

The indica placed on the left part of a right footed shooter's mat is intended for classroom use to aid in the memorization of what the player is expected to do when using the tool.

If the mat is made of rubber, the bottom should be striated or otherwise conditioned to render it substantially skidproof on wet grass. The mat as a whole should be suitable for both dry and inclement weather.

While a circular raised ball support—annular—has been discussed above, the shape is not critical and can be square or triangular or any other suitable shape to elevate the ball off the playing surface of the mat, to simulate the ball lying in the grass of a soccer field. In the same mode of thinking, the oval central opening of the CMA could be circular or round as well. Oval is preferred to prevent damage at any hard corner that can easily occur and the foot being long and relatively narrow fits better in an oval rather than a circle.

Better soccer players are built not born. This device enables even young soccer players to be built into future stars of the game.

Since certain changes may be made in the described apparatus without departing from the scope of the invention herein involved, it is intended that all matter contained in the above description and shown in the accompanying drawings shall be interpreted as illustrative and not in a limiting sense.

I claim:

1. A device, available in mirror image left and right footed kicker models, to aid in instructing basic kicks of a soccer ball for use by students in a game of soccer, the device comprises:

a mat having an upper side and a bottom side, the bottom side being substantially skidproof on grass, the upper side being divided into a trio of laterally connected areas; namely, a right area, a center area and a left area, referred to respectively as the RMA; the CMA and the LMA;

the RMA of the right footed kicker model being generally flat and preferably having indicia thereon to direct an approaching student kicker to a raised ball support positioned at an end of the mat distant from the approaching kicker to retain a ball in a position that simulates placement of the ball on a grassy field;

the CMA being a separate elongated fiat section having a central opening, said opening being large enough to receive only a single foot, and preferably carrying information on a surface of said section advising the student to place a non-kicking foot within the central opening; and the LMA of the right footed kicker model being a generally flat area preferably having instructional indicia printed thereon.

2. The device of claim 1 wherein the CMA is colorimetrically separated from at least one of the RMA and LMA.

3. The device of claim 1 wherein the CMA is colorimetrically separated from both of the RMA and LMA.

4. The device of claim 1 wherein the LMA further includes a rearwardly directed arrow which serves as a guide to point directly at a right footed kicker during the kicker's run toward the CMA and RMA.

5. The device of claim 1 wherein the LMA contains printed indicia concerning the playing of the game of soccer.

6. The device of claim 1 wherein the mat is rubber and the indicia is painted on in a high solid paint.

7. The device of claim 1 wherein the RMA has a greater extension from front to back and the LMA has the least extension.

8. The device of claim 1 wherein the indicia of the RMA is the word STRIKEFOOT and a forwardly directed area directed toward said raised ball support.

9. A device, available in mirror image left and right footed kicker models, to aid in instructing basic kicks of a soccer ball for use by students in a game of soccer, the device comprises:

a mat suitable for outdoor use in dry and inclement weather, having an upper side and a bottom side, the upper side being divided into a trio of laterally connected areas; namely, a right area, a center area and a left area, referred to respectively as the RMA; the CMA and the LMA;

the RMA of the right footed kicker model being generally flat and preferably having indicia thereon to direct an approaching student kicker to a raised annular ball support positioned at an end of the RMA distant from the approaching kicker to retain a ball in a position that simulates placement of the ball on a grassy field;

the CMA being a separate elongated flat section having a central preferably oval opening, said opening being large enough to receive only a single foot, and preferably carrying information on a surface of said section advising the student to place a non-kicking foot within the central opening;

the LMA generally flat area preferably having instructional indicia printed thereon; and wherein the CMA is colorimetrically separated from both of the RMA and LMA.

10. The device of claim 9 wherein the LMA further includes a rearwardly directed planar arrow which serves as a guide to point directly at a kicker during the kicker's run toward the CMA and RMA.

11. The device of claim 9 wherein the CMA includes the words PLANT FOOT and a series of arrows directed toward the central opening.

12. A device, for a left footed kicker, to aid in instructing basic kicks of a soccer ball for use by students in a game of soccer, the device comprises:

a mat having an upper side and a bottom side, the bottom side being substantially skidproof on grass, the upper side being divided into a trio of laterally connected areas; namely, a right area, a center area and a left area, referred to respectively as the RMA; the CMA and the LMA;

the LMA of the left footed kicker model being generally flat and preferably having indicia thereon to direct an approaching student kicker to a raised ball support positioned at the end of the LMA distant from the approaching kicker, to retain a ball in a position that simulates placement of the ball on a grassy field;

the CMA being a separate elongated flat section having a central opening, said opening being large enough to receive only a single foot, and preferably carrying information on a surface of said section advising the student to place a non-kicking foot within the central opening; and the RMA is generally a flat area, preferably having instructional indicia printed thereon.

13. The device of claim 12 wherein the CMA is colorimetrically separated from at least one of the RMA and LMA.

14. The device of claim 12 wherein the RMA further includes a rearwardly directed planar arrow which serves as a guide to point directly at a left footed kicker during a kicker's run toward the CMA and LMA.

15. The device of claim 12 wherein the raised ball support of the LMA is annular.

16. The device of claim 12 wherein the indicia of the RMA is printed in color on a contrasting background, the background being colorimetrically separated from the CMA.

17. The device of claim 9 wherein the indicia of the LMA is printed in color on a contrasting background, the background being colorimetrically separated from the CMA.

* * * * *